US008561275B2

(12) United States Patent
Wille

(10) Patent No.: US 8,561,275 B2
(45) Date of Patent: Oct. 22, 2013

(54) SETTING DEVICE WITH A VARIABLE SETTING STROKE ADJUSTMENT

(75) Inventor: Lothar Wille, Moerfelden-Walldorf (DE)

(73) Assignee: Gesipa Blindniettechnik GmbH, Moerfelden-Walldorf (DE)

( * ) Notice: Subject to any disclaimer, the term of this patent is extended or adjusted under 35 U.S.C. 154(b) by 84 days.

(21) Appl. No.: 13/161,109

(22) Filed: Jun. 15, 2011

(65) Prior Publication Data

US 2011/0308055 A1 Dec. 22, 2011

(30) Foreign Application Priority Data

Jun. 22, 2010 (DE) ..... 10 2010 024 610

(51) Int. Cl.
*B21J 15/00* (2006.01)
*B21J 15/30* (2006.01)

(52) U.S. Cl.
USPC ..... 29/243.525; 29/243.523; 72/391.2; 72/391.4

(58) Field of Classification Search
USPC ..... 29/243.521–243.525; 72/391.2, 391.4
See application file for complete search history.

(56) References Cited

U.S. PATENT DOCUMENTS

| | | | | |
|---|---|---|---|---|
| 4,574,612 | A | 3/1986 | Tanikawa | |
| 5,357,666 | A * | 10/1994 | El Dessouky et al. | 29/243.521 |
| 6,272,899 | B1 | 8/2001 | Bentivogli | |
| 6,449,822 | B1 * | 9/2002 | Gilbert et al. | 29/243.521 |
| 7,032,281 | B1 * | 4/2006 | Lin | 29/243.525 |
| 7,155,953 | B1 * | 1/2007 | Nikkel | 72/391.8 |
| 8,161,622 | B2 * | 4/2012 | King et al. | 29/243.521 |

FOREIGN PATENT DOCUMENTS

| | | |
|---|---|---|
| CN | 2154138 | 1/1994 |
| CN | 101304827 | 11/2008 |
| DE | 34 19 687 | 11/1984 |
| EP | 0 999 906 | 5/2000 |
| EP | 1 525 928 | 5/2005 |
| JP | 59-188158 | 12/1984 |
| JP | 5-067861 | 9/1993 |
| JP | 2001-510733 | 8/2001 |
| JP | 2005-46862 | 2/2005 |
| WO | 99/04917 | 2/1999 |

OTHER PUBLICATIONS

Russian Office action conducted in counterpart Russian Appln. No. 2011125158/02 (Aug. 7, 2012) (with English language translation).
Japanese Office action conducted in counterpart Japanese Appln. No. 2011-132327 (Oct. 30, 2012) (with Englsih lanugage translation).
Chinese Office Action conducted in Chinese counterpart Appln. No. 201110163382.6 (Jun. 21, 2013) (w/ English language translation).

* cited by examiner

*Primary Examiner* — David B Jones
(74) *Attorney, Agent, or Firm* — Greenblum & Bernstein, P.L.C.

(57) ABSTRACT

Setting device with a variable setting stroke adjustment and method of setting the setting stroke of setting device. Setting device includes a housing, a pulling rod structured and arranged for movement in an axial direction, an adjustably positionable stop element structured and arranged to adjustably limit a setting stroke of the pulling rod, and a locking element movable between a closed position and an adjustment position. The stop element has at least one region with a polygonal contour, and, in the closed position, the locking element engages in a path of motion of edges of the polygonal contour and, in the adjustment position, releases the path of motion.

20 Claims, 3 Drawing Sheets

SETTING DEVICE WITH A VARIABLE SETTING STROKE ADJUSTMENT

CROSS-REFERENCE TO RELATED APPLICATIONS

The present application claims priority under 35 U.S.C. §119 of German Patent Application No. 10 2010 024 610.7, filed on Jun. 22, 2010, the disclosure of which is expressly incorporated by reference herein in its entirety.

BACKGROUND OF THE INVENTION

1. Field of the Invention

The invention relates to a setting device, in particular for blind rivet nuts, with a variable setting stroke adjustment, which has a housing, in which a pulling rod is arranged in a moveable manner in the axial direction, wherein a setting stroke of the pulling rod is adjustable with a stop element which can be screwed into the housing.

2. Discussion of Background Information

Setting devices of this type are used, for example, in setting blind rivet nuts. Blind rivet nuts are used, for example, in metal sheets and other thin-walled workpieces, in which a thread cannot be made directly. The blind rivet nut is first twisted onto a tip of the pulling rod and then guided into an opening in the workpiece. A deformation of the blind rivet nut on the side of the workpiece facing away from the setting device takes place due to a subsequent tensile movement of the pulling rod. After the pulling rod has carried out the desired setting stroke, that is, the desired axial tensile movement, and thus a sufficient deformation of the blind rivet nut has taken place, the tensile movement of the pulling rod and thus the setting stroke are to be automatically ended and the pulling rod is to be twisted out of the blind rivet nut. The blind rivet nut then remains in the workpiece.

Depending on the thickness of the workpiece and the embodiment of the blind rivet nut, a different size of setting stroke is necessary. Accordingly, the setting stroke is adjustable in most setting devices. The adjustment is carried out in that an adjustable limit in the form of a stop element is provided in the housing for the movement of the pulling rod. The position of the stop element inside the housing thereby determines the setting stroke. The pulling rod is then axially moveable until it bears against the stop element with a mating surface. This leads to a marked increase in force, which leads to the ending of the setting stroke and the start of the twisting out movement.

The stop element can therefore be positioned at different points in the housing to adjust the setting stroke. It is thereby known to screw the stop element into the housing to different extents, whereby the position of the stop element in the housing can be variably adjusted. However, it is problematic with this approach that the position of the stop element can change independently in particular with vibrations, so that an unintentional shifting of the setting stroke can occur.

SUMMARY OF THE INVENTION

Embodiments of the invention ensure a secure position of the stop element in the housing.

According to embodiments, a setting device of the type mentioned at the outset includes a stop element having at least one region with a polygonal, in particular regularly polygonal contour, and a locking element, which can be moved between a closed position and an adjustment position. In the closed position, the locking element engages in a path of motion of edges of the polygonal contour and releases the path of motion in the adjustment position.

During the screwing-in, a rotation of the stop element occurs. The edges of the polygonal contour accordingly move during the screwing-in movement on a circular path of motion. The locking element can now be positioned between two edges such that it engages in the path of motion of the adjacent edges and thus prevents a rotation movement of the stop element. When the locking element is in the closed position, a rotation of the stop element and thus a change of the setting stroke is therefore effectively prevented. By displacement of the locking element into the adjustment position, the path of motion of the edges is released, so that a rotation of the stop element is possible. In this case, the setting stroke can be adjusted by a simple rotation of the stop element, whereby this is screwed into or out of the housing.

It is particularly preferred that in the closed position the locking element bears flat against a surface between adjacent edges of the polygonal contour. The term "flat" in this context also includes a linear contact. A locking of the setting stroke as it were is carried out by the displacement of the locking element into the closed position, the stop element must be in an angular position in which the locking element can bear flat against a surface between adjacent edges. By displacement of the locking element into the closed position, a slight angular adjustment of the stop element can optionally be caused. Depending on the embodiment, a locking can be achieved in such a manner that an adjustment of the setting stroke takes place in steps depending on the ratio of thread pitch to the number of edges or surfaces.

Preferably, the stop element is embodied or formed as a hollow cylinder, so that the pulling rod extends axially through the stop element and the stop element has a stop surface projecting radially inwards. The stop element is therefore arranged around the pulling rod in a relatively space-saving manner. Through the stop surface projecting radially inwards this can be embodied or formed to be relatively large, so that relatively large forces can be transferred. The stop element thereby has an external thread with which it can be screwed into the housing. Optionally, a guide can be provided, in order to guide the pulling rod axially inside the stop element so that a secure support of the pulling rod is achieved. Because it surrounds the pulling rod, the stop element can be reached relatively easily from outside, so that a simple adjustment of the setting stroke can be made by rotation of the stop element.

It is particularly preferred thereby that the polygonal contour is embodied or formed as an outside contour. The processing of an outside contour is relatively simple, so that the stop element can be produced with low expenditure. There is also a relatively large space available around the stop element to accommodate the locking element in the housing. Through the embodiment as an outer contour, there is a relatively large circumferential surface available thereby for embodying or forming the polygonal contour, so that either many edges can be embodied or formed or the surfaces between the adjacent edges can be relatively large. While a larger momentum can possibly be absorbed by the locking element as a result of larger surfaces, a smaller step width in the adjustment of the setting stroke is possible as a result of an increase in the number of edges or corners of the polygonal contour.

Advantageously, the locking element has a circumferential recess which in the closed position is arranged outside the path of motion of the outer edges and in the adjustment position is arranged inside the path of motion of the outer edges. One is then relatively free in the further embodiment of the locking element. It is necessary only for the locking element to be displaceable such that the circumferential recess can be displaced into the region of the path of motion of the outer edges.

It is particularly preferred thereby that the locking element is held resiliently in the closed position. This ensures that the stop element can be screwed into or out of the housing only when the locking element is actuated. Without actuation of the locking element, an adjustment of the setting stroke is not possible. An unintentional adjustment of the setting stroke is prevented thereby.

Preferably, the locking element can be moved perpendicular to the axial direction, so that the locking element can be moved laterally past the stop element. A displacement of the circumferential recess perpendicular to the axial direction occurs such that when the locking element is guided laterally past the stop element, first a bearing surface or bearing line of the locking element is present on the surface between adjacent edges of the polygonal contour until the circumferential recess is positioned above this surface, so that the path of motion of the edges is released. When the stop element is screwed in or out, the edges of the contour then move through the circumferential recess of the locking element. With this embodiment, the locking element can be guided in the housing on both sides of the pulling rod, so that a stable support of the locking element with slight free travel is possible. An exact adjustment of the setting stroke can be realized thereby.

In a preferred embodiment, the housing has an opening, through which the stop element is manually accessible. For example, through this opening, a region of the circumferential surface of the stop element is accessible such that a momentum can be transferred to the stop element. In this way, the stop element is screwed into or out of the housing. The stop element can be guided in the housing with relatively little friction, since a locking into place of the stop element in the housing and thus of the setting stroke is carried out with the aid of the locking element. Therefore, only relatively slight forces are necessary for screwing the stop element in or out. It is therefore possible to adjust the setting stroke without tools.

Preferably, one end of the locking element is accessible through an opening in the housing, so that the locking element can be pressed into the housing. The locking element can thus likewise be actuated manually, such that a pressing-in movement can be carried out relatively easily. Through the pressing-in, the locking element is displaced into the adjustment position, wherein the circumferential recess of the locking element is positioned above the stop element such that the path of motion of the edges of the polygonal contour is released. As soon as the locking element is no longer pressed, it is moved with the aid of a return element, such as, for example, a spring, back into the closed position, in which it engages in the path of motion of the edges and thus prevents a further rotation of the stop element. It is thereby also discernible from outside whether the locking element has been moved back securely into the closed position. If necessary, a slight movement of the stop element is necessary by manual intervention.

Preferably, the polygonal contour is embodied or formed as a regular n-sided figure, wherein n in particular=6, 7, 8, 9, 10 or 12. A uniform locking or indexing is thereby possible so that a sufficiently accurate adjustment of the setting stroke can be realized. Thus, for example, a scale can be provided that gives the adjusted setting stroke exactly in mm, for example. Through the interaction between the polygonal contour and the locking element, the stop element cannot adopt any arbitrary angular position, but only angular positions in which a surface between the edges of the polygonal contour runs parallel to the corresponding surface of the locking element. The setting stroke is thus likewise adjustable only in a stepwise manner, so that these steps can be adjusted exactly. The adjustment of unintentional intermediate values is not possible, since then either the locking element is not displaced into its closed position or with movement into its closed position the stop element is moved slightly therewith.

Advantageously, the pulling rod has a replaceable threaded mandrel. By a replacement of the threaded mandrel of the pulling rod, this can be adapted to different fastening means, such as, for example, to blind rivet nuts with different diameters. The setting device can thus be used in a very variable manner. The adjustment of the setting stroke respectively necessary can thereby be carried out without tools.

It is particularly preferred thereby that a mating surface of the pulling rod which interacts with the stop surface is independent of the threaded mandrel. The mating surface is thus connected to the pulling rod in a stationary manner. The adjusted setting stroke is then not changed by a replacement of the threaded mandrel. Instead, the setting stroke is independent of the threaded mandrel respectively used.

Embodiments are directed to a setting device with a variable setting stroke adjustment that includes a housing, a pulling rod structured and arranged for movement in an axial direction, an adjustably positionable stop element structured and arranged to adjustably limit a setting stroke of the pulling rod, and a locking element movable between a closed position and an adjustment position. The stop element has at least one region with a polygonal contour, and, in the closed position, the locking element engages in a path of motion of edges of the polygonal contour and, in the adjustment position, releases the path of motion.

According to embodiments of the invention, the setting device may be structured and arranged for blind rivet nuts. Further, the stop element can be structured for screw engagement and adjustment with the housing. The polygonal contour can include a regular polygonal contour.

In accordance with other embodiments, the stop element may include a hollow cylinder and have a stop surface projecting radially inwards. The pulling rod may extend axially through the stop element.

According to other embodiments, the locking element can have a circumferential recess positionable so that, in the closed position, the circumferential recess is arranged outside the path of motion of the edges and, in the adjustment position, the circumferential recess is arranged inside the path of motion of the edges.

In accordance with still other embodiments, the locking element may be resiliently held in the closed position.

According to embodiments of the invention, the locking element can be movable perpendicularly to the axial direction, and the locking element may be movable laterally past the stop element.

According to other embodiments, the housing can have an opening structured and arranged to provide manual access to the stop element.

Further, one end of the locking element can be accessible through an opening in the housing, and the locking element can be pressable into the housing.

In accordance with still other embodiments of the instant invention, the polygonal contour may include a regular n-sided figure, wherein n=6, 7, 8, 9, 10 or 12.

According to embodiments, the pulling rod has a replaceable threaded mandrel.

In accordance with other embodiments, a mating surface of the pulling rod which interacts with the stop surface may be independent of the threaded mandrel.

Embodiments of the invention are directed to a method of adjusting the setting stroke of the above-described setting device that includes moving the locking element to the adjustment position, moving the stop element to an adjusted setting stroke position, and moving the locking element to the closed position.

According to embodiments of invention, the moving of the locking element to the adjustment position can include pressing the locking element inward, relative to the housing, against a spring force, and the moving of the locking element to the closed position can be effected through the spring force.

In accordance with other embodiments of invention, the moving of the locking element to the adjustment position may include sliding a circumferential recess formed in the locking element to surround the path of motion, and the moving of the locking element into the closed position may include sliding the circumferential recess out of the path of motion.

According to embodiments, in the closed position, the locking element is arranged along a flat surface of the polygonal contour to prevent rotation of the stop element.

Embodiments of the invention are directed to a method of adjusting the setting stroke of a setting device that includes moving a locking element surrounding a pulling rod to an adjustment position, moving the stop element having a polygonal contour to an adjusted setting stroke position. and moving the locking element to a closed position that prevents movement of the stop element.

According to embodiments of the invention, the moving of the locking element to the adjustment position can include pressing the locking element inward, relative to the housing, against a spring force, and the moving of the locking element to the closed position can include pushing the locking element outward via the spring force.

In accordance with still yet other embodiments of the present invention, the moving of the locking element to the adjustment position may include sliding a circumferential recess formed in the locking element to surround the path of motion, and the moving of the locking element into the closed position may include sliding the circumferential recess out of the path of motion.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
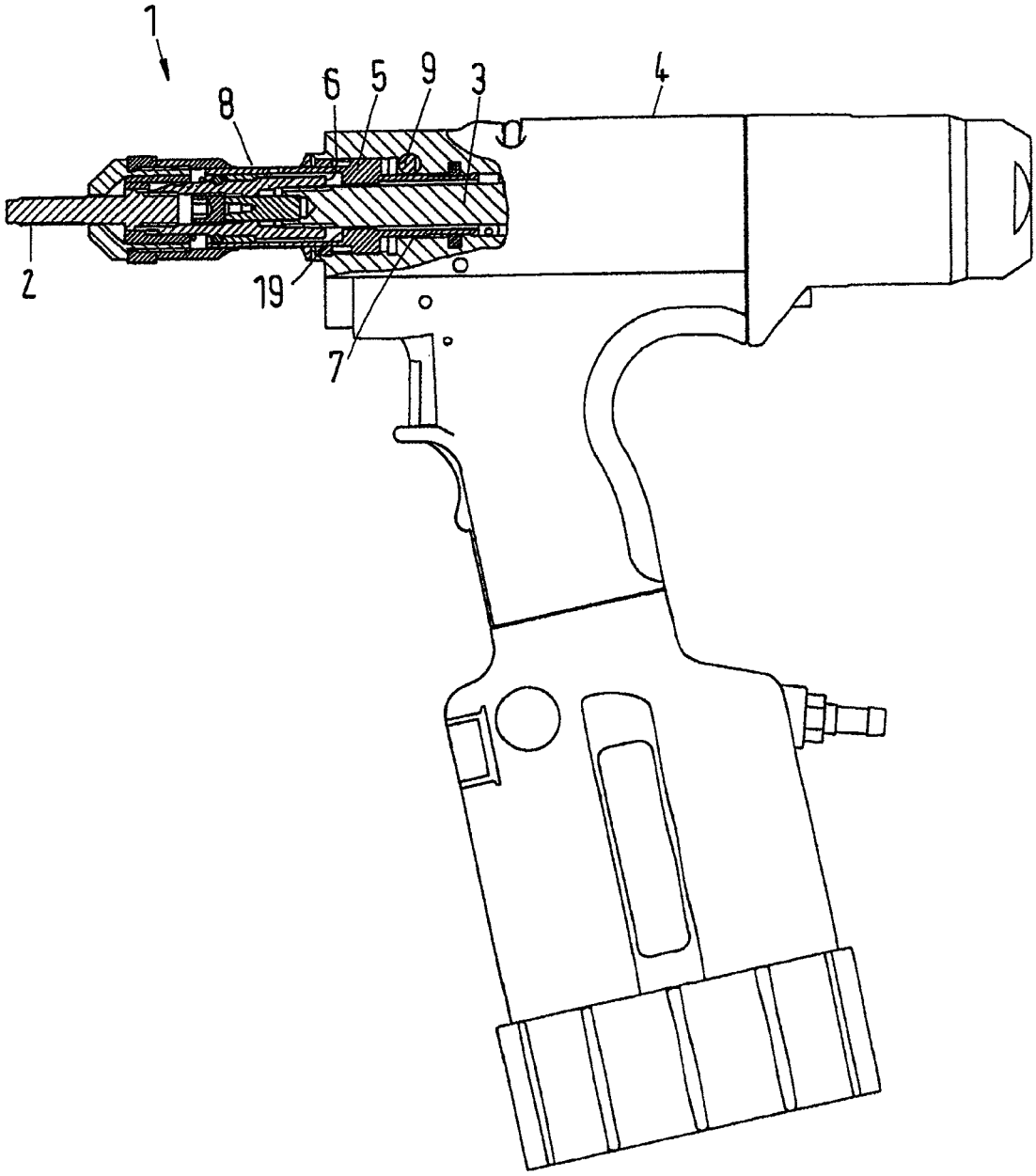
FIG. 1 illustrates a setting device in diagrammatic representation.

FIG. 1 shows a setting device 1 which can be used, for example, for setting blind rivet nuts. Blind rivet nuts can be twisted onto a replaceable threaded mandrel 2 of a multiple-part pulling rod 3 is arranged to carry out a rotational movement. For this purpose pulling rod 3 is supported in a housing 4 of the setting device 1 in a rotatable and in the axial direction displaceable manner. The rotational movement of pulling rod 3 is preferably generated via a pneumatic motor, while the axial tensile movement is effected with the aid of a pneumatic-hydraulic pressure booster.

Pulling rod 3 is thereby pulled from the starting position shown in FIG. 1 into the housing 4 in the axial direction, whereby a tensile movement is exerted on the blind rivet nut (not shown), which is twisted onto threaded mandrel 2. This results in a deformation of the blind rivet nut such that it is held in a workpiece in a positive manner. The length of the tensile movement and thus of the setting stroke is dependent on the thickness of the workpiece and the embodiment of the blind rivet nut.

The setting stroke is adjustable by a positioning of a stop element 5. In this way, a mating surface 6 associated with pulling rod 3 bears against stop element 5 at the end of the setting stroke. Mating surface 6 may be integrally formed as port of pulling rod 3 or may be provided on a separate element.

Stop element 5 is embodied or formed as a hollow cylinder and can be screwed into housing 4 via a thread assembly 7. The position of stop element 5 is changed and thus the setting stroke is adjusted depending on how far stop element 5 is screwed into housing 4.

Pulling rod 3 is arranged to axially project through hollow cylindrical stop element 5, which provides a radial support of pulling rod 3 so that the pulling rod 3 is guided free from vibrations.

For introducing the rotation necessary for screwing into or out of hollow cylindrical stop element 5, an opening 8 is provided in housing 4, through which opening a circumferential surface of the stop element is manually accessible. An adjustment of the setting stroke is thus possible without tools. In the region of opening 8, a scale can also be provided on the circumferential surface of the stop element 5 so that the adjusted setting stroke can be read off or visually confirmed from the scale.

In order to also prevent an unintentional adjustment of the angular position of stop element 5 and thus of the adjusted setting stroke when vibrations occur, a locking element 9 is provided. Locking element 9 can be movable perpendicular to the axial direction or tensile direction of pulling rod 3 and is thereby guided laterally past the pulling rod 3. In the exemplary embodiment of FIG. 1, locking element 9 can be moved perpendicular to the drawing plane.

Figure 2:
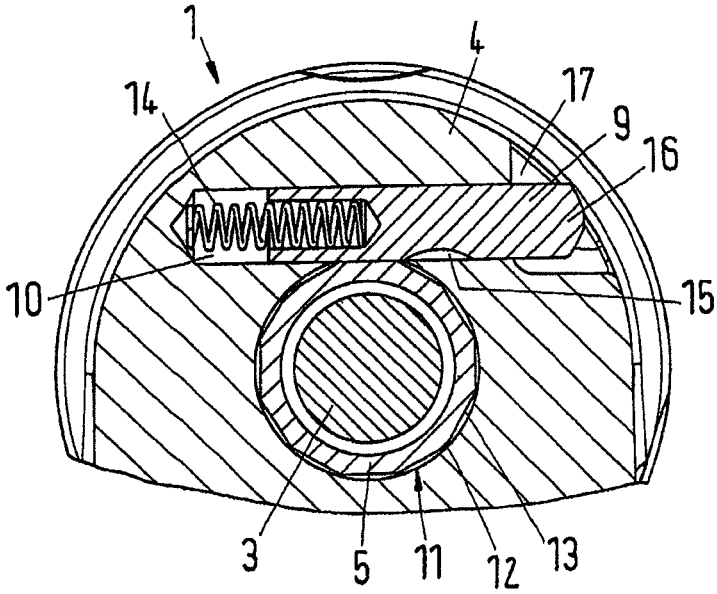
FIG. 2 illustrates a cross section through the setting device with the locking element in the closed position.

FIG. 2 shows the locking element 9 and its interaction with the pulling rod 3 in detail. In the representation according to FIG. 2, locking element 9 is located in its closed position. Locking element 9 is essentially embodied as a circular cylindrical pin, which is guided in a bore 10 in housing 4. Stop element 5 has a region with a polygonal outer contour 11, which in this exemplary embodiment is embodied or formed as a regular dodecagon. The polygonal outer contour 11 in this exemplary embodiment has twelve edges 12. A surface 13 is respectively embodied or formed between adjacent edges 12. In the closed position of locking element 9 shown, locking element 9 bears flat against a surface 13 of outer contour 11 of stop element 5, so that a rotation of the stop element 5 is not possible. Since locking element 9 is embodied or formed in a circular cylindrical manner, the contact between locking element 9 and surface 13 is strictly speaking a linear contact. However, in this context this is also to be considered as a flat contact.

Locking element 9 is held in the closed position with the aid of a spring. On its circumference locking element 9 has a circumferential recess 15, which in the closed position is covered by a wall of bore 10.

One end 16 of locking element 9 is accessible from outside through an opening 17 in housing 4, so that, for example, locking element 9 can be pressed by a finger into housing 4, in the representation in FIG. 2, to the left. A linear displacement of locking element 9 from the closed position against the force of the spring 14 into an adjustment position, as shown in FIG. 3, occurs thereby.

Figure 3:
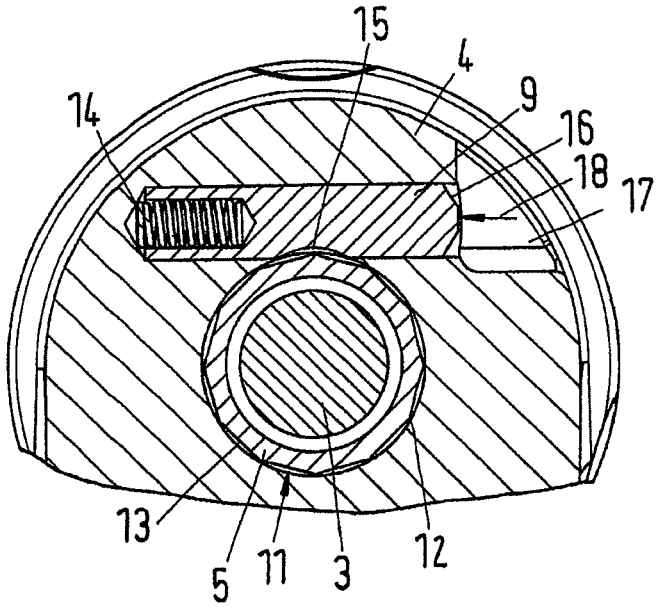
FIG. 3 illustrates a cross section according to FIG. 2 with the locking element in the adjustment position.

FIG. 3 shows locking element 9 in the adjustment position. An arrow 18 is intended to symbolize a force which acts on end 16 of locking element 9 sufficient to press locking element 9 into housing 4 against the force of spring 14. In the adjustment position, circumferential recess 15 is located above pulling rod 3 such that edges 12 of polygonal contour 11 can be moved through circumferential recess 15 to facilitate a rotation of stop element 5. Locking element 9 thus releases the path of motion of edges 12 in adjustment position. FIG. 3 shows an angular position of the stop element 5 which can be achieved when locking element 9 is located in the adjustment position. By releasing locking element 9 is pushed or pressed out of housing 4 by the force of the spring 14, so that circumferential recess 15 is moved back into a position in which it is covered inside bore 10. An angular adjustment of stop element 5 can occur as surface 13 bears against locking element 9. Thus, only defined angular positions of stop element 5 can be adjusted. An indexing of the adjustable setting stroke can thereby occur.

By the use of the locking element an adjustment of the setting stroke of the setting device for blind rivet nuts can be carried out without tools. At the same time it is ensured that an unintentional adjustment (re-adjustment) of the setting stroke, for example, by vibrations does not occur. Relatively large forces can be absorbed by the locking element thereby, since it is supported in the housing on both sides of the region in which forces are absorbed. Accordingly, an adjustment of the setting stroke relatively free from play is possible. A release is thereby carried out by simple pressure and linear displacement of the locking element, which is moved with the aid of a spring back into the locked position. Without intentional actuation, the locking element therefore is always in its closed position in which no adjustment of the setting stroke can be made.

In all, therefore, a relatively simply structured adjustment possibility for adjusting the setting stroke without tools is created through the embodiment according to the invention, wherein at the same time an unintentional adjustment by vibrations, for example, is prevented.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A setting device with a variable setting stroke adjustment, comprising:
   - a housing;
   - a pulling rod structured and arranged for movement in an axial direction;
   - an adjustably positionable stop element structured and arranged to adjustably limit a setting stroke of the pulling rod; and
   - a locking element movable between a closed position and an adjustment position,
   - wherein the stop element has at least one region with a polygonal circumference moveable along a path of motion, so that, in the closed position, the locking element restricts movement of the polygonal circumference along the path of motion and, in the adjustment position, the locking element allows movement of the polygonal circumference along the path of motion.

2. The setting device according to claim 1, wherein the setting device is structured and arranged for blind rivet nuts.

3. The setting device according to claim 1, wherein the stop element is structured for screw engagement and adjustment with the housing.

4. The setting device according to claim 1, wherein the polygonal circumference comprises a regular polygonal circumference.

5. The setting device according to claim 1, wherein the stop element comprises a hollow cylinder and has a stop surface projecting radially inwards, and the pulling rod extends axially through the stop element.

6. The setting device according to claim 1, wherein the locking element has a circumferential recess positionable so that, in the closed position, the circumferential recess is arranged outside the path of motion and, in the adjustment position, the circumferential recess is arranged around at least a part of the path of motion of the edges.

7. The setting device according to claim 1, wherein the locking element is resiliently held in the closed position.

8. The setting device according to claim 1, wherein the locking element is movable perpendicularly to the axial direction, and the locking element is movable laterally to the stop element.

9. The setting device according to claim 1, wherein the housing has an opening structured and arranged to provide manual access to the stop element.

10. The setting device according to claim 1, wherein one end of the locking element is accessible through an opening in the housing, and wherein the locking element is pressable into the housing.

11. The setting device according to claim 1, wherein the polygonal circumference comprises a regular n-sided geometric figure, wherein n=6, 7, 8, 9, 10 or 12.

12. The setting device according to claim 1, wherein the pulling rod has a replaceable threaded mandrel.

13. The setting device according to claim 5, wherein the pulling rod comprises a mating surface structured and arranged to interact with the stop surface is independent of the threaded mandrel.

14. A method of adjusting the setting stroke of the setting device according to claim 1, comprising:

moving the locking element to the adjustment position;

moving the stop element to an adjusted setting stroke position; and moving the locking element to the closed position.

15. The method according to claim 14, wherein the moving of the locking element to the adjustment position comprises pressing the locking element, relative to the housing, inward against a spring force, and wherein the moving of the locking element to the closed position is effected through the spring force.

16. The method according to claim 14, wherein the moving of the locking element to the adjustment position comprises sliding a circumferential recess formed in the locking element around at least a part of the path of motion, and wherein the moving of the locking element into the closed position comprise sliding the circumferential recess out of the path of motion.

17. The method according to claim 14, wherein, in the closed position, the locking element is arranged along a flat surface of the polygonal circumference to prevent rotation of the stop element.

18. A method of adjusting the setting stroke of a setting device, comprising:

moving a locking element surrounding a pulling rod to an adjustment position;

moving a stop element having a polygonal circumference to an adjusted setting stroke position; and moving the locking element to a closed position that prevents movement of the stop element.

19. The method according to claim 18, wherein the moving of the locking element to the adjustment position comprises pressing the locking element inward, relative to the housing, against a spring force, and wherein the moving of the locking element to the closed position comprises pushing the locking element, relative to the housing, outward via the spring force.

20. The method according to claim 18, wherein the moving of the locking element to the adjustment position comprises sliding a circumferential recess formed in the locking element around at least a part of the path of motion, and wherein the moving of the locking element into the closed position comprise sliding the circumferential recess out of the path of motion.

* * * * *